United States Patent [19]

Zetterström

[11] 3,940,253

[45] Feb. 24, 1976

[54] DEVICE FOR THE PURIFICATION OF PROCESS WASTE GASES

[75] Inventor: Karl Axel Zetterström, Trollhattan, Sweden

[73] Assignee: Volvo Flygmotor Aktiebolag, Trollhattan, Sweden

[22] Filed: Dec. 7, 1973

[21] Appl. No.: 423,371

[52] U.S. Cl. ..... 23/277 C; 110/8 A; 431/284

[51] Int. Cl.[2] ..... F23G 7/06

[58] Field of Search ..... 23/277 C; 110/8 A; 431/284, 351, 352; 432/72

[56] References Cited

UNITED STATES PATENTS

| | | | |
|---|---|---|---|
| 3,567,399 | 3/1971 | Altmann et al. | 23/277 C |
| 3,595,015 | 7/1971 | Kretschmer | 23/277 C X |
| 3,603,081 | 9/1971 | McCrocklin | 23/277 C X |
| 3,837,303 | 9/1974 | Baardson | 110/8 A |
| 3,854,288 | 12/1974 | Heitland et al. | 23/288 F |

*Primary Examiner*—Joseph Scovronek
*Assistant Examiner*—Barry I. Hollander
*Attorney, Agent, or Firm*—Pollock, Vande Sande & Priddy

[57] ABSTRACT

A combustion chamber device for the purification of process waste gases from poisonous, noisome and/or other noxious constituents by combustion while using a support combustion device and under conditions used in gas turbine technology. The process gases to be purified are fed into the combustion chamber through the axial central inlet thereof, and the combustion chamber is provided with a special inlet for further additional air. A flame tube is disposed inside the combustion chamber wall and spaced therefrom. The flame tube is arranged to be cooled by means of a film of the main part of the further additional air entering through the special inlet.

3 Claims, 1 Drawing Figure

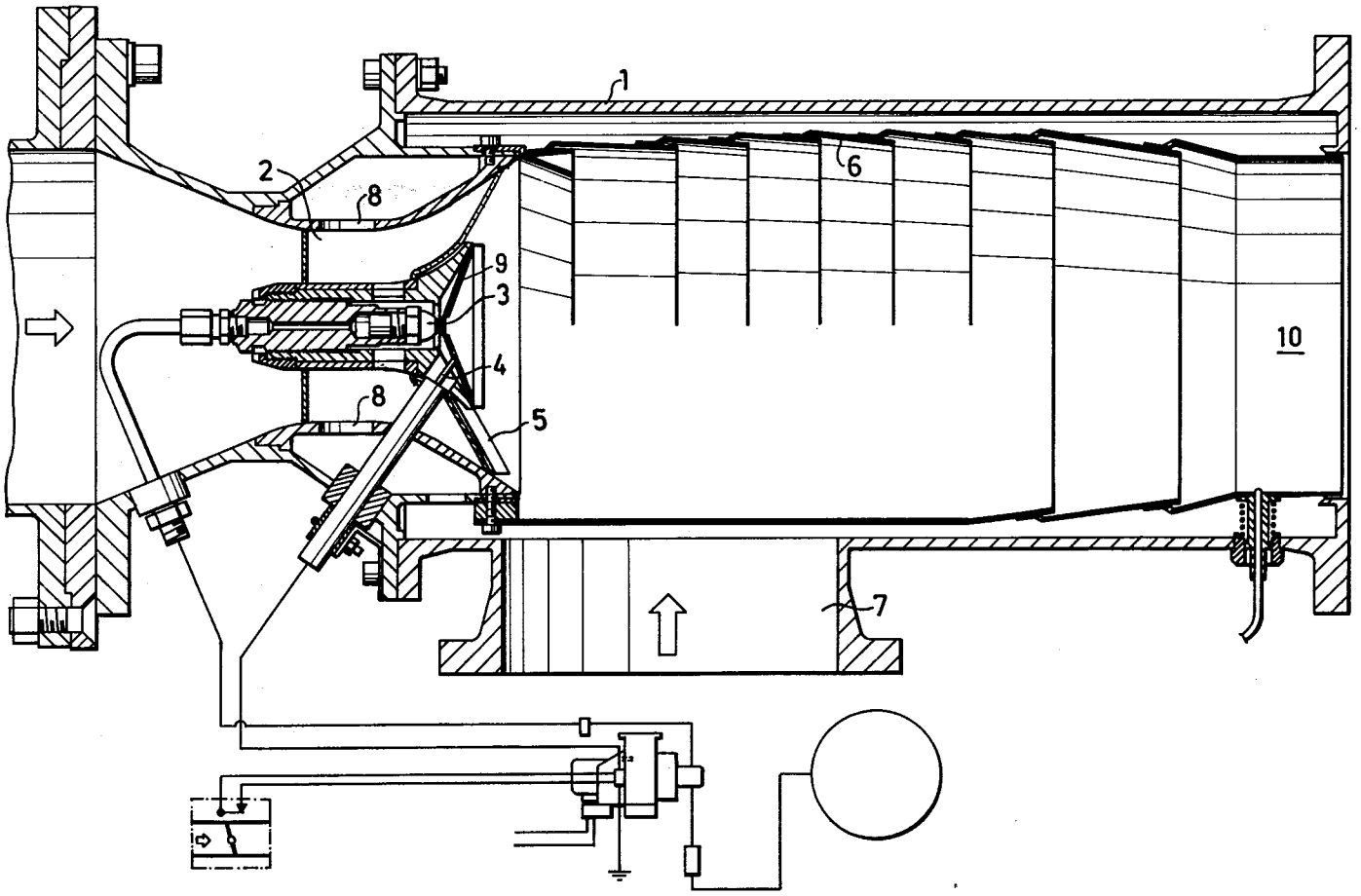
10
6
1
7
5
9
3
4
8
8
2

DEVICE FOR THE PURIFICATION OF PROCESS WASTE GASES

The present invention relates to a device for the purification of process waste gases from poisonous, odious and/or other noxious constituents by combustion while using a support combustion device and under conditions in the gas turbine such as are used technology process gases to be purified being fed into the combustion chamber through the axial central inlet thereof. If desired, air may be added to the combustion chamber in order to avoid too high a proportion of impurities in the gas mixture.

In many industrial processes, especially in the chemical and metallurgical industry, air and/or gas mixtures, are formed containing a considerable amount of poisonous, noisoml explosive and/or in other ways noxious constituents which for environmental reasons should or must be removed before the gas mixture is discharged into the ambient atmosphere. A typical example is the suiphate cellulose process wherein odious waste gases often are discharged into the atmosphere. In most cases it has been determined by means of research and development work what noxious constituents should be removed from the different process waste gases. Thus, the unpleasant odour of the waste gases from sulphate cellulose plants derives from a number of sulphur compounds.

Noxious constituents have already been removed from process waste gases in accordance with several different main principles, a very common one being combustion. In such case the waste gases are passed through a furnace chamber which is usually provided with a brick lining and in which a flame or an electric arc is generated, heating the gas to a temperature necessary for the combustion of the constituents to be removed to form harmless substances such as water vapour, carbon dioxide, etc. However, the flow and the composition of the process waste gases can vary as a function of time for one and the same process, and in order to assure that the noxious constituents are effectively destroyed, the previously used furnace chambers have been constructed with a large extension in the flow direction or with a large volume altogether so that in all cases a sufficient residence time of the gas in the chamber is assured.

However, when applying said combustion method to many industrial processes, particularly the sulphate cellulose process, it has been found that the process waste gases require a very large furnace chamber under said conditions. in a current case the weight of the furnace chamber would be about 10 tons. It is obvious that such a chamber will be bulky and also expensive to operate since the brick lining normally has to be replaced once a year. Until now no really successful attempts have been made to achieve the same effective combustion of the noxious constituents of process waste gases in a more simple way, in spite of the great need thereof.

British Pat. No. Specification No. 884 627 describes a method of carrying out combustion in a gas turbine. However, said method can be used successfully only when the amount of process waste gas is small in relation to the amount of air sucked in by the gas turbine and when the residence time of the waste gas is sufficiently long. If these conditions are not fulfilled, the combustion will be impossible to control, and serious superheating problems will arise.

Thus, the main object of the present invention is to provide a device which allows the combustion of noxious constituents to be carried out in a surprisingly simple and favourable way without any superheating. The device according to the invention is distinguished in that the combustion chamber is provided with a special inlet for further additional air and that a flame tube is disposed inside the combustion chamber wall and spaced therefrom, which flame tube is arranged to be cooled by means of a film of the main part of the further additional air entering through the special inlet.

The combustion takes place by applying the technology used in gas turbines. This means, in the first place, that the combustion is carried out in a combustion chamber under carefully determined flow conditions for the process waste gases. More exactly, the combustion is carried out in a chamber having a cross section, suitably circular, and, so dimensioned that the gas flow will maintain a mainly axial flow direction during the whole heating and combustion process. The combustion is maintained by means of a support flame near the gas inlet, preferably having a central location in relation to said inlet. By means of suitable known devices, the support flame is extended in a combustion zone across the whole cross-section of the combustion chamber to assure that all parts of the waste gases penetrating into the chamber will be heated at least to the temperature required for the combustion of the constituents to be destroyed.

Another basic condition well-known from gas turbine technology is that the average value of the gas flow rate through the chamber substantially shall exceed the speed of propagation of the combustion in the gas.

The term "process waste gases", as used herein, is meant to comprise all common gas mixtures. Thus, a chemical or other process can of course emit a waste gas which practically consists of air containing a minor proportion of noxious or nasty-smelling substances, such as sulphur compounds, carbon monoxide, etc., which substances must be destroyed before the air is discharged into the surrounding atmosphere. Other processes provide heavily contaminated waste gases containing only a moderate amount of air and, for the rest, compounds which must be destroyed, such as carbon monoxide and others. In, for example the sulphate digestion process, non-condensable gases are obtained which, in addition to nitrogen, carbon monoxide and formic acid, also contain the previously mentioned noisome, organic sulphur compounds. In the preparation of mineral wool, on the other hand, waste gases are obtained which mainly contain carbon monoxide in a content as high as about 15 %.

Thus, a common feature of the process waste gases is that, to a larger or smaller extent, these gases have a greater energy value than pure air. The supply of heat by the support flame is therefore adjusted so that the combustion of the supplied fuel and the combustible components of the waste gases will give a temperature sufficiently high to permit the final oxidation of the waste gas components to be destroyed.

A combustion chamber according to the invention will be described in detail in the following, referring to the attached drawing with a single FIGURE showing a vertical longitudinal view in section of the combustion chamber.

The combustion chamber illustrated is provided with an outer surrounding casing 1 having a substantially circular cross section. At one of its ends, said casing 1 is provided with an inlet 2 for the process waste gases to be purified in the combustion chamber. The waste gases are supplied to said inlet 2 by means of a suitable suction fan. The inlet 2 is dimensioned so that the gas will attain the necessary flow rate when entering the chamber. The inlet 2 is further so constructed together with the chamber casing 1 that the gas flow will maintain a substantially axial flow direction through the whole length of the chamber.

An injection device 3 for a suitable fuel is disposed near the inlet end of the chamber. Although practically any gaseous or liquid fuel can be used, it is preferred to use an oil firing unit known per se, the injection nozzle of which is disposed centrally in the injection device 3. One or more ignition means 4 are disposed at the orifice of the nozzle. In order to facilitate satisfactory operation of the device, it is essential that the support flame from the injection device 3 be expanded over the whole cross-section of the combustion chamber as quickly as possible, and for this purpose flame holding means 5, known from gas turbine technology, are distributed around the injection device 3. All of the gas entering through the inlet 2 will thus be forced to pass through a flame curtain which rapidly and extremely efficiently will heat the gas flow to the ignition temperature necessary for the combustion of the constituents to be destroyed.

A flame tube 6 is coaxially disposed inside the casing 1 and spaced therefrom. Said flame tube 6 is cooled by means of a thin air film. The air for this film is fed through a cooling air inlet 7 in the casing 1 and is then passed through the gap between the casing 1 and tube 6 and also into the tube 6 via slots distributed along both the length and periphery of said tube. In this way, the necessary corrosion and flame protection is attained as regards the tube 6 which per se eliminates the need of chamber lining and which can be made of comparatively cheap materials.

The length of the combustion chamber is sufficient to guarantee that all parts of the entering process waste gas are heated to the temperature necessary for the combustion of the noxious constituents of said gas. One or more air inlets 8 are disposed in the inlet end of the combustion chamber near the injection device 3. By means of said inlets 8, additonal air can be fed centrally into the combustion chamber not only for controlling the final temperature at the combustion chamber outlet 10 but also for cooling, in the form of a film, the injection device 3, a so called swirl 9 and the inside of the finger like flame holding means 5.

The purified gas mixture leaving the combustion chamber outlet 10 has a high heat value and can therefore be utilized in various processes. A combustion chamber device according to the invention has been used to treat 800 $Nm^3$ waste gases from the cooking and the evaporation steps in a sulphate cellulose plant. Said process waste gases containned carbon monoxide and odious sulphur compounds while the purified gases leaving the chamber outlet 10 had a temperature of 1400°C and contained only harmless compounds, carbon monoxide and water and a minor amount of sulphur compounds which were not odious.

The greatest advantage of the device according to the invention is the very substantial decrease of the space required. Another advantage of the device according to the invention as compared to the previously used very large furnace chamber is that the combustion starts immediately after the waste gases have entered the chamber. When starting the known furnaces after a breakdown, it may happen that at first no combustion takes place in spite of the support flame due to insufficient concentration of the combustible constituents of the gas. When these constituents then reach the necessary concentration an explosive combustion can occur, and it is not unusual to have several such explosions occur after one another. This behavious must, of course, be considered in the strength calculations of these futnace chambers. However, in the device according to the invention no such explosive combustion will take place.

What I claim is:

1. Apparatus for the purification by combustion of waste gases emanating from chemical processes and the like and having poisonous, odious and/or other noxious and/or corrosive constituents comprising:

an elongate outer casing, an inner flame tube disposed within but spaced from said outer casing and providing an inner surface which is exposed to the combustion of the waste gases occurring in said flame tube, means for admitting air into the space between said flame tube and said outer casing, means comprising a multiplicity of through slots in said inner flame tube spaced about the periphery of said flame tube and along its length for permitting the flow of air from said space into said flame tube to flow as a thin film of air over the inner surface of said air tube, means for burning a fuel at said inlet end of said flame tube, means for spreading the flame from the burning fuel over the entire cross-sectional area of said flame tube, and means for admitting the gases to be purified into an inlet end of said flame tube and for passing said gases through the flame of the burning fuel, the purified gases following combustion in said flame tube exiting at the other end of said flame tube.

2. The apparatus of claim 1 which further includes an inlet means for admitting outside air for admixture with said gases to be purified before entry into said flame tube.

3. The apparatus of claim 1 wherein said flame tube is of circular cross-section and has a substantially uniform inner diameter over its length.

* * * * *